United States Patent [19]

Molloy

[11] Patent Number: 4,928,916

[45] Date of Patent: May 29, 1990

[54] CEILING PANEL INSTALLATION SUPPORT WITH TELESCOPING PANEL REST FOR EASE OF CARRYING

[76] Inventor: John F. Molloy, P.O. Box 3482, Stamford, Conn. 06905

[21] Appl. No.: 344,693

[22] Filed: Apr. 28, 1989

[51] Int. Cl.[5] ..... E04G 25/00

[52] U.S. Cl. ..... 248/354.1; 414/11

[58] Field of Search ..... 248/354.1, 354.5, 600, 248/601, 615, 616, 357, 677, 188.8; 414/11; 269/289 R

[56] References Cited

U.S. PATENT DOCUMENTS

| | | | |
|---|---|---|---|
| 2,937,842 | 5/1960 | Meek | 248/354.5 |
| 3,930,645 | 1/1976 | Anderson | 254/289 R |
| 4,120,484 | 10/1978 | Zimmer | 414/11 X |
| 4,482,130 | 11/1984 | Paredes | 414/11 X |
| 4,576,354 | 3/1986 | Blessing | 248/354.5 |
| 4,695,028 | 9/1987 | Hunter | 414/11 X |
| 4,733,844 | 3/1988 | Molloy | 248/354.1 |
| 4,736,983 | 4/1988 | Furbee | 248/600 |
| 4,811,924 | 3/1989 | Walters | 248/354.5 X |

FOREIGN PATENT DOCUMENTS

| | | | |
|---|---|---|---|
| 825146 | 12/1951 | Fed. Rep. of Germany | 248/600 |

*Primary Examiner*—J. Franklin Foss

*Attorney, Agent, or Firm*—Parmelee, Bollinger & Bramblett

[57] ABSTRACT

A ceiling panel installation support includes a rectangular tubular cushioned panel rest which during operation conveniently temporarily holds a ceiling panel, such as a sheet rock panel, up against an overhead ceiling structure while the panel is being secured in place by permanent attachment to the overhead structure by nails or screws or other fastening means. In preparing the present ceiling panel installation support for shipment, for storage or for carrying from one job site to another, the rectangular tubular cushioned panel rest is easily detached from its operating position at the upper end of the upright elongated, spring-biased, releasable-clutch-controlled jacking assembly. Then, this tubular panel rest is placed in telescoping relationship around the jacking assembly as a temporary housing for providing a compact and unified easily carried or stored package of components. A number of additional enhanced features are described in relation to the sheetrock support device disclosed and claimed in Patent No. 4,733,844, issued on March 29, 1988.

7 Claims, 5 Drawing Sheets

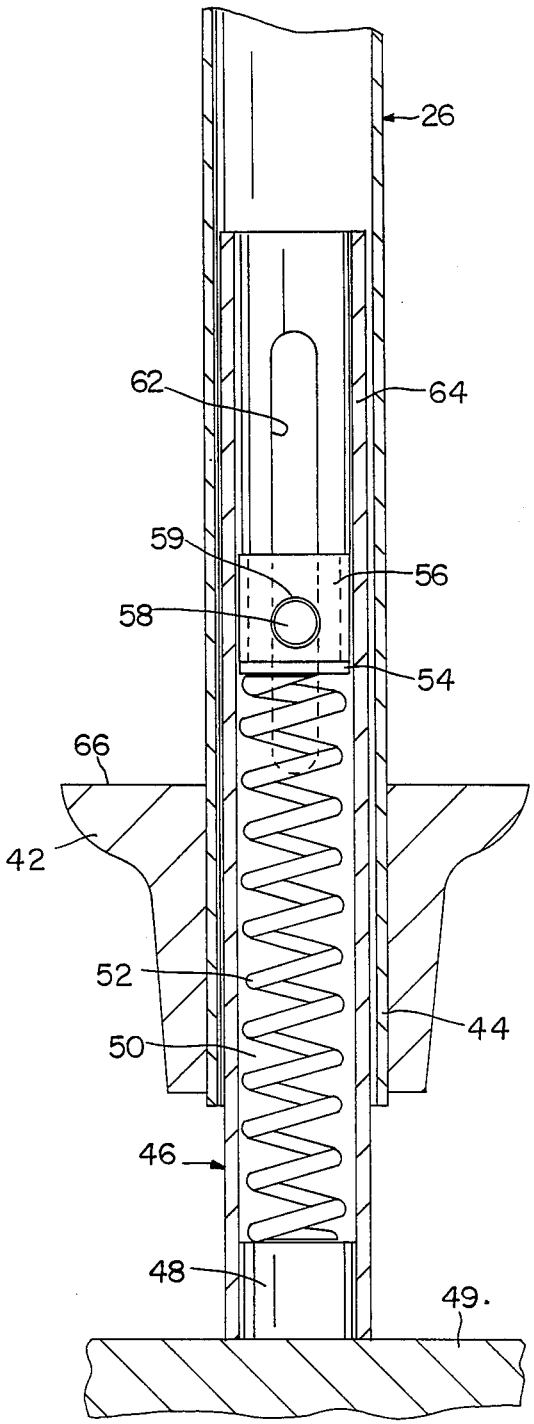
FIG.2
FIG.3
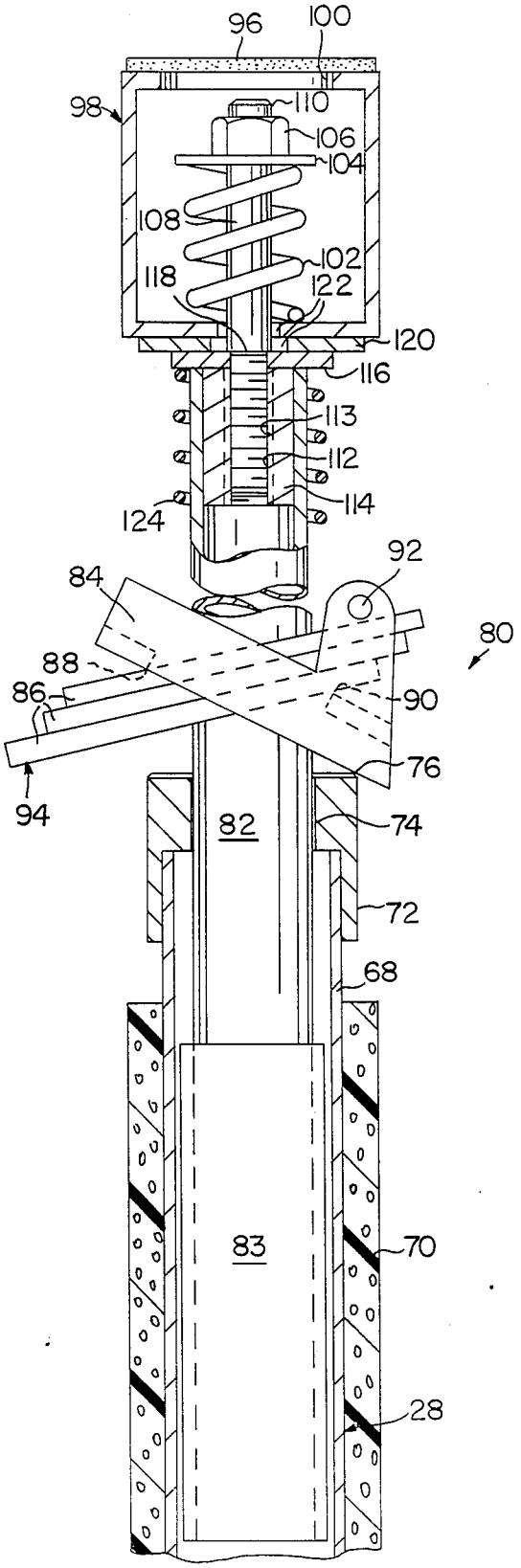

CEILING PANEL INSTALLATION SUPPORT WITH TELESCOPING PANEL REST FOR EASE OF CARRYING

BACKGROUND

The referenced sheet rock support of Molloy disclosed and claimed in U.S. Pat. No. 4,733,844 has proven to be highly serviceable and readily adaptable and adjustable to varied working areas, heights and loads and in providing ease of maneuverability. That prior sheetrock support device is easily adjusted to various desired heights and to the desired upward pressures in one step and also is easily released from its temporary supporting position below the sheetrock after such a ceiling panel has been permanently fastened in place on the overhead structure. The present invention provides a number of improvements over that prior successful sheetrock support device.

In U.S. Pat. No. 4,695,028 of Hunter is disclosed a device for holding construction materials, such as sheet rock, up against an overhead ceiling structure. A long tension spring is located within an outer lower tubular column and is attached at its upper end to the upper end of this tubular column. The lower end of this tension spring is attached to the lower end of an upper shaft which telescopes within the outer lower tube. Thus, this tension spring is continually urging the upper shaft toward the ceiling. In operation, the user must grasp an arm of a sheet rock support located at the top end of the telescoping upper shaft and then pull down on this arm whenever the user wishes to move the sheet rock support structure downwardly away from the ceiling. In other words, the user is forced to fight against this long tension spring whenever the user wants to reduce the height of the sheet rock support structure by telescoping the upper shaft downwardly within the tubular column. The further down that the user telescopes the upper shaft, the greater the opposing force of the stretched tension spring which must be overcome.

A first problem with this Hunter sheetrock support device is that the user is always fighting against a powerful and long tension spring when reducing height. This tension spring must be long, with a long available travel and be powerful to be able to accommodate various floor-to-ceiling heights always with enough residual force available at maximum height in order to support the sheetrock load. Consequently, a second problem with the Hunter device occurs when supporting sheetrock against a low ceiling in that the upward thrust of the stretched tension spring may excessively compress the sheetrock against the ceiling joists or other building structure.

After the user has pulled down on the overhead support arms for fully telescoping the upper shaft, a trigger handle having a second spring serving as a trigger spring, engages in an aperture in the upper shaft. The trigger handle is now holding the upper shaft in fully telescoped relationship and the long tension spring is now fully stretched. A third problem with the Hunter device is the inherent danger resulting from the stored energy in a large, long stretched tension spring temporarily held in its fully stretched condition by a trigger handle. In effect, it is like a catapult. Inadvertent release of the trigger handle when no sheetrock has yet been loaded onto the support, could cause the support to accelerate upwardly and slam against the ceiling with considerable speed, momentum and impact force. If a person inadvertently happened to have a hand, arm or head in the path of such a catapult-like action, severe injury could occur.

Further problems with such a prior art device result from the awkwardness and unbalanced offset weight of a laterally projecting trigger handle. In addition, there is the extra cost involved with the Hunter trigger handle, its hinged mounting and its relatively large compression trigger spring. The X-shaped sheetrock support at the top is bulky, heavy, and difficult to move around.

It is an object of the present invention to provide a ceiling panel installation support (which may be called a "sheetrock jack") that is truly convenient to use, relatively light in weight, compact for travel from job to job and for storage, and relatively inexpensive and not complex.

SUMMARY

A ceiling panel installation support includes a rectangular tubular cushioned panel rest which during operation conveniently temporarily holds a ceiling panel, such as a sheetrock panel, up against an overhead ceiling structure while the panel is being secured in place by permanent attachment to the overhead structure by nails or screws or other fastening means. In preparing the present ceiling panel installation support for shipment, for storage or for carrying from one job site to another, the rectangular tubular cushioned panel rest is easily detached from its operating position at the upper end of the upright elongated, spring-biased, releasable-clutch-controlled jacking assembly. Then, this tubular panel rest is placed in telescoping relationship around the jacking assembly as a temporary housing for providing a compact and unified, easily carried or stored package of components.

The present invention provides a number of improvements over the sheet rock support device disclosed and claimed in the above-referenced patent. These improvements include: a new more compact foot step and compression spring assembly; a new support column comprising two staged length adjustment tubes instead of three; an improved manual-release clutch. Further improvements are: a resilient comfortable high friction cylindrical hand grip; an inturned flange top bushing; an anti-top-jam clutch spring; pneumatic control and damping of the descent of the panel rest and its telescoping rod when the clutch is released to prevent a slam-down; and the removable rectangular tubular cushioned panel rest which serves as a temporary housing for shipment storage and for convenient carrying from one job site to another.

BRIEF DESCRIPTION OF THE DRAWINGS

The various features, objects, aspects and advantages of the present invention will become more fully understood from a consideration of the following detailed description in conjunction with the accompanying drawings, which are not drawn to scale but are arranged for clarity of illustration. Corresponding reference numerals are used to indicate like components throughout the various views.

In the drawings:

FIG. 2 is an enlarged axial sectional view of the lower portion of the installation support shown in FIG. 1.

FIG. 3 is an enlarged elevational sectional view of the upper portion in the of the installation support shown in FIG. 1.

FIG. 6 shows the anti-top-jam clutch spring.

DESCRIPTION OF THE PREFERRED EMBODIMENTS

Figure 1:
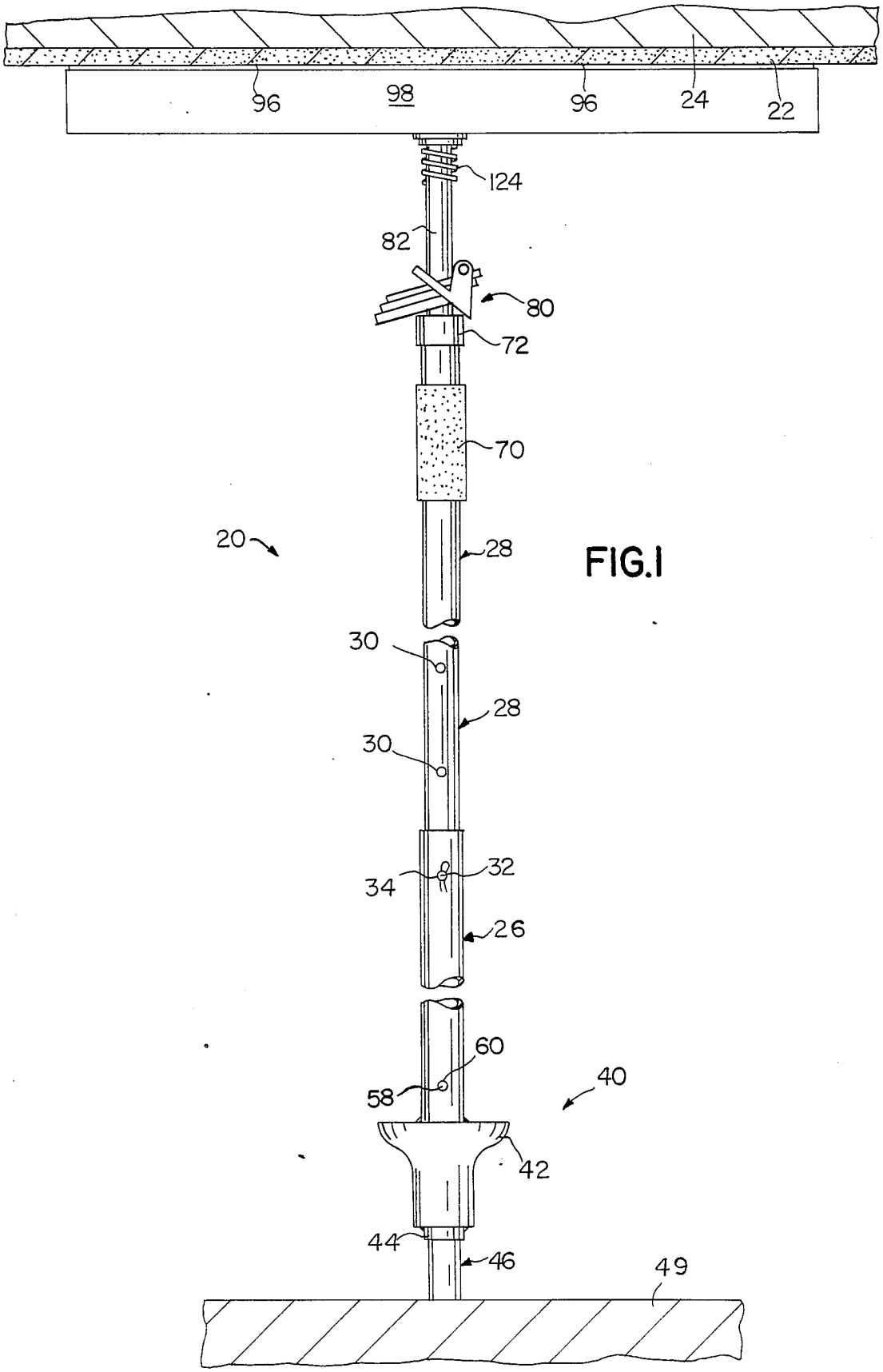
FIG. 1 is an elevational view of a temporary support device for use during ceiling panel installation constructed in accordance with the invention and being shown in its panel-supporting position.

Referring to FIG. 1, a ceiling panel installation support device 20 in accordance with the invention is shown in its operating position for temporarily holding a ceiling panel 22, for example a panel of sheet rock, up firmly against an overhead ceiling structure 24 to which the panel 22 is to be permanently secured by screws, nails, or other fasteners. This ceiling panel installation support 20 includes a tubular support column comprising a lower support tube 26 into which is received an upper support tube 28. The effective length of this support column 26–28 is adjustable in stages 30 defined by transverse openings through which can be inserted a headed pin 32 removably held by a clevis clip. This headed pin is inserted through an upper transverse opening 34 near the top of the lower support tube by aligning this opening 34 with one of the adjustable-length staged openings 30 for thereby removably attaching upper support tube 28 to lower support tube 26 to provide an effective support column of the desired length.

The present invention provides a number of improvements over the sheet rock support device described and claimed in the earlier Molloy Patent referenced above. These improvements will be pointed out as the description proceeds.

Figure 4:
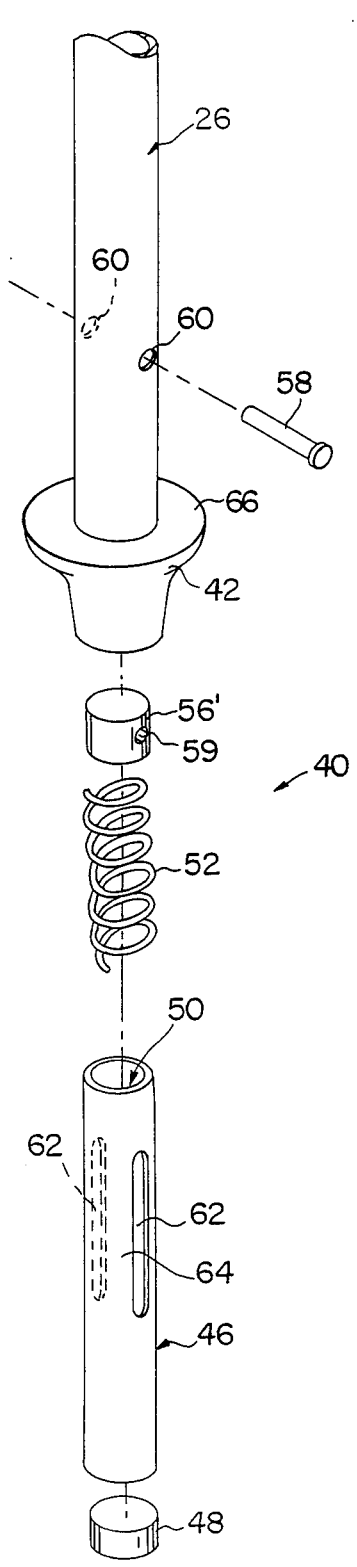
FIG. 4 is an exploded perspective view of the components shown in FIG. 2.

First Improvements: In order to provide an upward thrust for pressing the panel 22 up against the overhead structure 24, there is a new arrangement of a compression foot step and compression spring assembly 40 as shown in FIGS. 2 and 4. The compression foot step or flange 42 encircles and is rigidly and permanently affixed directly to a bottom portion 44 of the lower support tube 26, for example being secured thereto by a press fit of this step 42 onto the exterior surface of the tube portion 44. In addition, the bottom end 44 of the tube 26 is flared out below the step for extra support. By virtue of this permanent direct attachment of the step 42 to the exterior surface of the tube portion 44, the full interior of this tube bottom portion 44 is now unobstructed for a new and more compact arrangement of a compression spring assembly to be described. A floor-engaging tube 46 has a plug 48 rigidly secured therein, for example by a permanent press fit, such that the bottom of this plug 48 is flush with the bottom end of the floor-engaging tube 46 for resting onto a floor 49 and for excluding dirt and abrasive particles from a spring chamber 50 now located within the floor-engaging tube 46. A compression spring 52 has its lower end seating down onto the plug 48, so that this grit-excluding plug also serves as a spring stop. The upper end of this spring 52 thrusts up against a spring stop disc 54, which may be a large washer, seating up against a stop sleeve 56. This stop sleeve 56 is fixedly held in place by a peened rivet 58 extending through a transverse opening 59 in the sleeve and a transverse opening 60 (Please see also FIGS. 1 and 4.) in the lower support tube 26, such opening 60 being positioned above the level of the foot-step 42. This rivet 58 also serves as a guide and is vertically slidably received in a pair of vertical guide slots 62 located in opposite walls of an upper portion 64 of the floor-engaging tube 46. Instead of sleeve 56 (FIG. 2) and disc 54, a solid cylindrical slug 56′ (FIG.4) with a transverse opening 59 may be employed, but the optimum arrangement is the sleeve 56 plus disc 54 because they provide a lighter assembly than a solid slug 56′.

During manufacturing assembly of the compression spring 52 between plug stop 48 and top stop means 54, 56, the spring is lightly pre-compressed (pre-loaded), so that the stop disc 54 is being firmly pushed up by the spring against the stop sleeve 56 even when the rivet guide 58 is at the top of the guide slots 62, i.e. even when the spring 52 is at its maximum permissible extension. The top stop means 54, 56 are dimensioned for freely sliding up and down within the upper portion 64 of the floor-engaging tube 46.

It is to be noted that this pre-loaded spring 52 and the guide slots 62 are now both located within the interior of the floor-engaging tube, and the guide pin-rivet 58 is now located above the pre-loaded spring 52, thereby providing a compact spring assembly wherein the spring is positioned at a level where the foot step 42 is located, and the spring now extends in a generally symmetrical relationship both above and below the foot step surface 66 where the user's foot is applied during operation for creating increasing compression in the spring 52. This new spring chamber 50 provides improved guidance for an appropriately sized spring.

Second Improvement: By virtue of the fact that the compression spring 52 is now located in a spring chamber 50 totally within the floor-engaging tube 46, a major portion of the lower support tube 26 is now unobstructed for receiving the upper support tube 28. In other words, there is advantageously increased room for telescoping of the upper tube 28 into the lower tube 26. Consequently, there is now achieved with two tubes 26, 28 sufficiently increased telescoping availability for staged adjustment in length that a third tube is eliminated (such third tube having been removably secured by a second pin and clevis in the prior Molloy sheet rock support device).

Third Improvement: As shown most clearly in FIG. 3, a resilient comfortable and high-friction cylindrical hand grip 70 of squeezable resilient material, such as foamed rubber, is cemented to an upper portion 68 of the upper support tube 28.

Fourth Improvement: As shown most clearly in FIG. 3, a bushing 72 having an inturned flange 74 is permanently attached to the upper end portion 68 of the upper support tube 28, for example by being pressed fit thereon. This new bushing 72 with inturned flange strengthens the upper end 68 of the support tube 28 and has a rounded shoulder 76 serving as a bearing surface for engaging the hand-releasable clutch 80 seen most clearly in FIG. 3.

This clutch 80 in its released position will allow a tubular top adjusting rod 82 to slide freely upwardly or downwardly through the clutch. A bearing sleeve 83 is permanently affixed to the lower end of the adjusting rod 82. This bearing sleeve 83 is dimensioned for sliding freely within tube 28 when the clutch 80 is released. The clutch 80 normally rests down on (or bears on) rounded shoulder 76 of the inturned-flange bushing 72. Friction clutch lever 84 clamps clutch pieces 86 together and binds them between the friction clutch lever's bearing points 88 and 90 in FIG. 3. Thus, the upward pressure of the rounded shoulder 76 on the clutch lever 84 causes the lever's bearing point 90 to press up against the lowermost clutch piece 86 on one side of the adjusting rod 82 while the lever's other bearing point 88 is caused to press down against the uppermost clutch piece 86 on the other side of the adjusting rod, thereby simultaneously tilting all of these clutch pieces 86 into a tight frictional grip on the adjusting rod 82. In order to release this tight friction grip, the user pushes upwardly with one hand at 94 in FIG. 3 against the extending end of the lowermost clutch piece 86, thereby restoring these pieces to a level (non-tilted) position and releasing their friction grip on the adjusting rod. The pin 92 bears down on the right end of the uppermost clutch piece 86 for keeping these pieces level when the released clutch 80 is sliding up or down along the adjusting rod 82.

Figure 5:
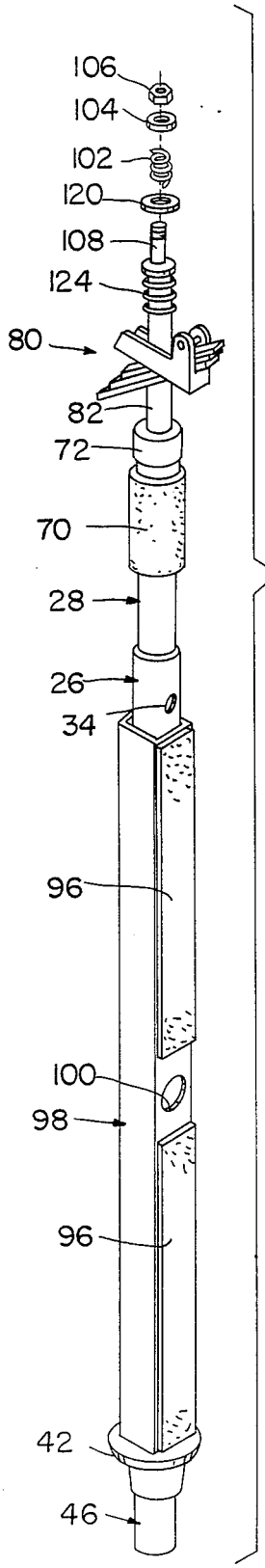
FIG. 5 is a perspective view of the whole installation support with uppermost components shown disassembled and with the rectangular tubular panel rest temporarily positioned in telescoped relationship for convenience in carrying to a new job site, storage or shipment.

Fifth Improvement: For supporting the ceiling panel 22, there is a tubular panel rest 98 (FIGS. 1 and 3) having a hollow rectangular cross-sectional shape, preferably a hollow square shape as shown in FIG.3. As seen most clearly in FIG. 5, this panel rest 98 has a pair of resilient foam cushion pads 96 extending along almost the entire top surface of the panel rest 98, being cemented thereon. These pads 96 are cemented to the panel rest 98 on opposite sides of a central access port 100. The purpose of this access port 100 is shown in FIGS. 3 and 5, because this port permits access for assembling a spring 102, a washer 104 and a nut 106 on the shank of a stud 108 whose upper end is threaded at 110. Then a socket wrench or other appropriate tool can be inserted through this port 100 for screwing the nut 106 onto the threads 110 for completing the attaching of the panel rest 98 onto the top of this installation support 20 (FIG. 1) in readiness for use.

The stud 108 is screwed at 113 into a socket 112 in a cylindrical plug 114 permanently press fitted into the top end of the tubular adjusting rod 82. A first washer 116 is captured by a stud shoulder 118 securely against the top end of the tubular adjusting rod 82 for protecting this upper end and for providing a seating surface for a "floating" second washer 120. This "floating" washer is considerably larger than the first washer and spans across substantially the full width of the lower surface of the square tube panel rest 98 for distributing the load across the bottom of this panel rest while it is supporting a ceiling panel 22 as seen in FIG. 1.

The openings at 122 in this floating washer and in the bottom of the panel rest 98 are considerably larger than the diameter of the shank of stud 108 for enabling the resilient connection provided by the components 102, 104, 106, 108, 110, 116 and 122 to permit the elongated support column to be tilted somewhat away from vertical while the horizontally extending panel rest 98 remains flush along the full length of both pads 96 firmly against an overhead panel 22.

By virtue of having the bottom of the panel rest 98 seat down directly on a floating washer 120 in turn directly seating on a captured washer 116, the panel rest has increased stability against inadvertent lateral canting or wobbling when a ceiling panel 22 is being supported on the panel rest in an unbalanced or offset position.

Sixth Improvement In order to prevent inadvertent binding engagement of the clutch 80 against the panel rest 98 if this clutch were to be allowed to become relatively slid all of the way up along the rod 82, for example if the apparatus were turned upside down, thereby binding the clutch in tight frictional grip on the rod 82 with the clutch jammed against the panel rest 98, thereby making subsequent hand-release of the clutch pieces 86 difficult, an anti-jam spring 124 encircles the top end of the adjusting rod 82 above the clutch 80 and below the captured washer 116. This anti-jam spring 124 prevents the locking or jamming binding of the clutch against the panel rest 98. Thus, this anti-jam spring 124 will keep the clutch 80 spaced a modest distance from the panel rest 98, such that no jamming of the clutch can occur.

Seventh Improvement: When the user is preparing to go to a new job site or to store or to ship the ceiling panel installation support 20, the access port 100 is used for easy removal of the panel rest 98. The panel rest is then telescoped over the remaining components as a convenient, compact, protective housing resting on the step 42, as shown in FIG. 5. The foating washer 120, spring 102, washer 104 and nut 106 are then temporarily replaced onto the stud 108 a seen in FIG. 5 so as to prevent their loss.

From the foregoing, it will be understood that an installer of overhead ceiling panels can place such panel 22, for example a sheetrock panel up against the overhead structure 24 and then while holding the panel up against the overhead structure with a first hand can use a second hand to grasp the installation support 20 for positioning the floor-engaging member 46 in a suitable position below the overhead panel and then can use the second hand to exert a thrust downwardly on hand grip 70 on the elongaged support rod 82 to position and place the horizontally extending panel rest 98 up against the panel for temporarily supporting the panel. Then, while holding the horizontally extending panel rest up against the panel with the second hand, can now release the first hand from holding the panel for now grasping the hand grip 70 on the tubular support column 26–28 with the first hand for thrusting downwardly on the tubular support column for compressing the compression spring 52. Also, the installer can push down with a foot on the surface 66 of step 42 for helping to compress spring 52, whereupon releasing both of the installer's hands and foot allows the compressed compression spring 52 simultaneously to thrust down upon floor-engaging member 46 and to thrust upwardly upon said tubular support column 26–28 for causing the friction clutch assembly 80 to be in friction gripping relationship with elongated support rod 82 for transmitting the upward thrust of the compressed compression spring through the elongated support rod 82 to the horizontally extending panel rest 98 for applying the upward thrust of the compressed compression spring through the cushion pads 96 to the panel 22 for temporarily holding and pressing the panel up against the overhead structure 24 in readiness for permanent fastening. After the panel 22 has been fastened in place, the friction clutch assembly 80 is manually released for removing the whole support 20. In order to release this clutch 80, the user normally must simultaneously press down with a foot on the foot step surface 66 for overcoming the thrust of the spring 52 while also pushing up with a thumb or finger at the region 94 on the clutch pieces 86. This is a safety feature which is important to understand and is in contradistinction to the Hunter device as discussed above in the BACKGROUND. The user of the present ceiling panel installation support (or "sheetrock jack") must simultaneously perform two operations in order to release the clutch 80. In summary, these two simultaneous operations are normally required for clutch release: (1) push down with a foot on the step 42 for relieving the spring force and (2) push up with a hand at 94 on the clutch pieces. Therefore, the clutch 80 cannot inadvertently or accidentally be released before the sheet rock or other panel has been affixed to the ceiling. (A very strong upward force at 94 on the clutch pieces could release the clutch without a foot simultaneously pushing down on the step 42, but such an excessively strong hand force is not normal operation.) In contrast, the Hunter device can be released by the sole operation of pushing inward on the trigger handle. If somebody fell against or bumped against the Hunter trigger handle, that prior art device would be released.

Figure 7:
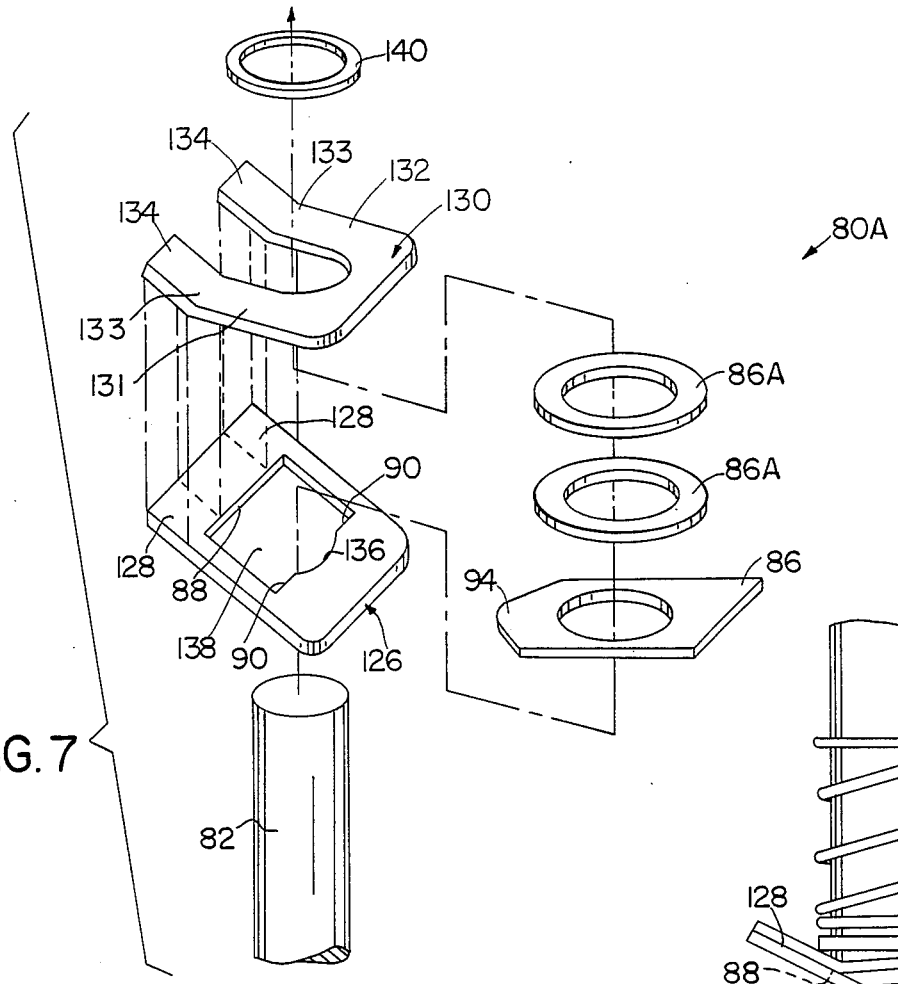
FIG. 7 is an exploded perspective view of the components of the simplified clutch shown in FIG. 6.
Figure 6:
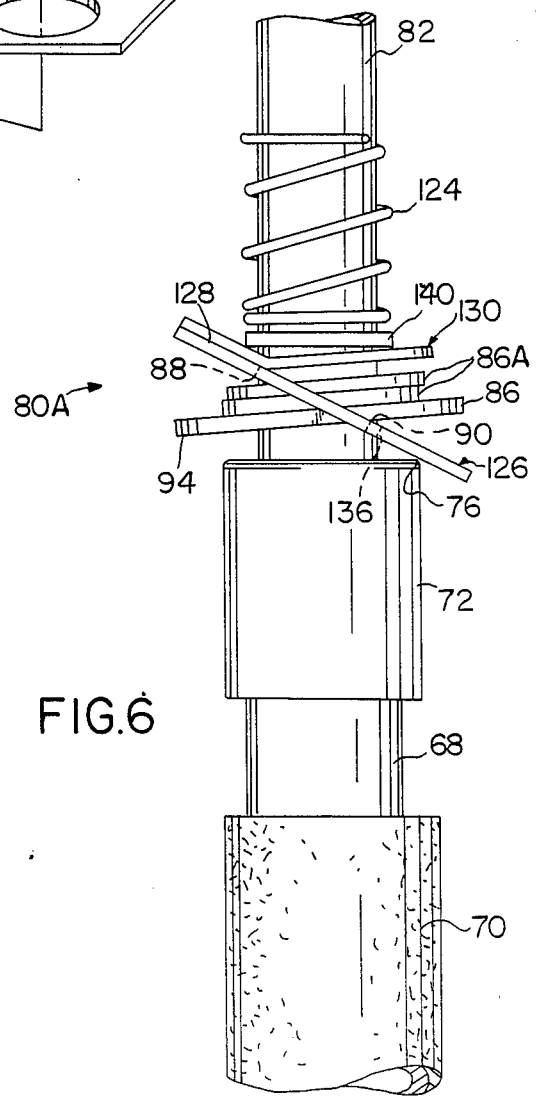
FIG. 6 is an elevational view of a modified and improved embodiment of the manually releasable clutch, which is simplified in construction from that shown in FIG. 3. Also.

Eighth Improvement: With reference to FIGS. 6 and 7, an improved and simplified manual release friction clutch 80A is shown. A clutch lever 84 includes an inclined or canted lower plate 126 which is permanently affixed at 128 to a U-shaped upper plate 130. For example, this attachment at 128 of the two legs 131 and 132 of the U-shaped upper plate to the lower plate 126 is by welding or brazing. These two legs 131 and 132 are permanently bent at 133 to form a pair of upturned feet 134 which are affixed at 128 so that the main portion of the upper plate 130 is substantially horizontal as seen in FIG. 6, while the lower clutch plate 126 is inclined to the horizontal at an acute angle, for example, in the range from about 15 degrees to about 35 degrees. In the illustrative embodiment as shown in FIG. 6, this inclination of the lower clutch plate is about 25 degrees to about 30 degrees. The main body of the upper clutch plate 130 is substantially horizontal, namely being within 10 degrees of horizontal. In this inllustrative embodiment the main body of the upper clutch plate has a small angle of about 5 degrees to the horizontal.

There is an arcuate cut out or recessed region at 136 in the rectangular opening 138 of the lower clutch plate. This arcuate cut-out provides clearance at the side of the telescopable top rod or tube 82 as seen in FIG. 6. The side 88 of the opening 138 opposite the arcuate cut-out 136 provides a clutch bearing point for pressing down on the uppermost of the stack of clutch pieces 86A and 86. The side 90 of the opening 138 provides another clutch bearing point for pressing up on the lowermost 86 of these clutch pieces for tilting the clutch pieces into frictional gripping engagement with the rod or tube 82 when the lower clutch plate 126 is in contact with the rounded shoulder bearing surface 74 of the busing 72, as shown in FIG. 6. There are two circular clutch pieces 86A, which advantageously can be a pair of ordinary low-cost washers of appropriate size. The third and lowest clutch piece 86 is generally rectangular in outline with a circular opening of substantially the same size as the openings in the washer-shaped clutch pieces 86A. The release end 94 of the lowermost clutch piece 86 is rounded and extended somewhat to provide a conveniently projecting thumb tab as seen at 94 in FIG. 6. A washer 140 rests on the upper clutch plate 130 and serves as a rest for the anti-jam spring 124.

Figure 8:
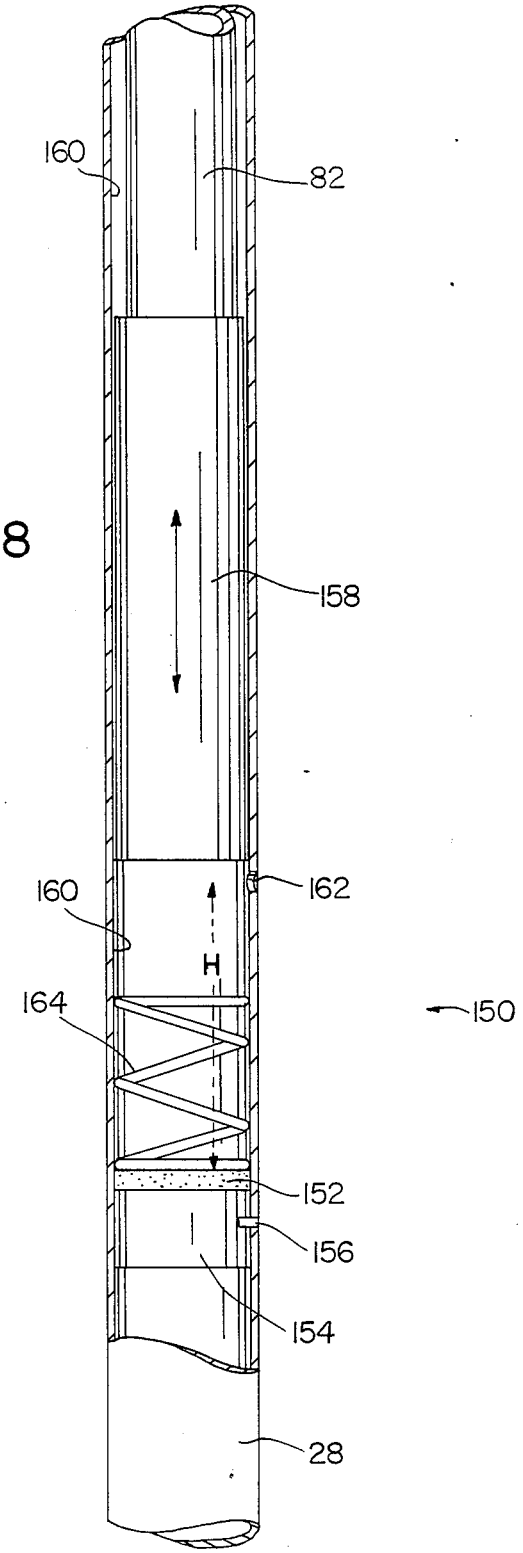
FIG. 8 is an elevational sectional view showing the lower end of the upper support tube in telescoping relationship within the lower support tube and including means for providing pneumatic control and damping of the descent of the upper support tube (or rod), when the clutch is released. This pneumatic control and damping prevents a slam-down of the upper support tube and the panel rest, after the clutch has been released.

Ninth Improvement: In order to control and damp the downward movement of the top telescoping rod or tube 82 after the clutch 80 or 80A has been released, pneumatic descent control means 150 may be provided as shown in FIG. 8. An essentially or substantially air-tight barrier 152 is installed in the upper support tube 28 and is supported on plug means 154 permanently pinned or staked in position within the tube 28. For example, a fastening pin 156 is shown. The pneumatic barrier 152 may comprise a rubber disc or gasket. It is located just below the lowest level of descent of the lower end of the top telescoping rod 82.

The lower end of the top telescoping rod 82 is formed into a pneumatic piston 158 by plugging the bore of the tubular rod 82 by a plug (not seen) and by surrounding this plugged end by a slippery plastic sleeve in sliding engagement with the bore 160 of the support tube 28. An air-escape port 162 is drilled in the wall of the support tube 28 at a convenient distance, for example at a height "H" in the range from about 2 inches to about 6 inches above the barrier 152.

In operation, after the ceiling panel has been fastened to the overhead structure, the clutch 80 or 80A is released by simultaneous down pressure on the foot step 42 and upward hand pressure at 94 on the lowermost clutch piece 86, and the piston 158 slides down relatively freely in the bore 160 as air freely is escaping through the air-escape port 162. Thus, the telescoping rod 82 and the panel rest 98 are allowed to descend relatively freely during most of their downward travel subsequent to release of the clutch 80 or 80A.

As soon as the piston 158 has passed the port 162, the escape of air is substantially blocked, and the descent of the telescoping rod 82 is now damped and slowed smoothly by a cushion of air trapped below the piston. There is a stop spring 164 resting on the barrier 152, 154 WhiCh finally serves to stop he downward travel of the piston 158 after its downward motion has become considerably damped by the cushion of trapped air. This stop spring 164 is appropriately positioned and is stronger than the anti-jam spring 126 so that this stop spring 164 will prevent the panel rest 98 from descending into contact with the anti-jam spring 124. Thus, the clutch 80 or 80A is relieved of unnecessary wear such as would be occassioned by downward pressure of the panel rest 98 on the anti-jam spring 124.

Since other changes and modifications varied to fit particular operating requirements and environments will be apparent to those skilled in the art, the invention is not considered limited to the example chosen for purposes of illustration, and covers all changes and modifications which do not constitute a departure from the true spirit of this invention as claimed in the following claims and equivalents of the claimed elements.

What is claimed is:

1. In a temporary support device for use in installing overhead construction material for aiding the installer in positioning and attaching such construction material to overhead structure, wherein said temporary support device includes a horizontally extending member upon which construction material can be supported temporarily, an elongated support rod adapted for being positioned generally vertically and having upper and lower ends, means connecting said horizontally extending member in generally perpendicular relationship to said upper end of said elongated support rod for permitting said elongated support rod to be tilted somewhat away from vertical while said horizontally extending member remains horizontal, a tubular support column having top and bottom ends, said lower end of said elongated support rod being received in said top end of said tubular support column in telescoping relationship therein for permitting said elongated support rod to be moved upwardly and downwardly relative to said tubular support column, a manually releasable one-way friction clutch assembly operably associated with said tubular support column and frictionally engageable with said elongated support rod for allowing said elongated support rod to be moved freely upwardly for extending said elongated support rod upwardly relative to said tubular support comumn while normally frictionally gripping said elongated support rod for preventing said elongated support rod from moving downwardly relative to said tubular support column, a vertically elongated, floor-engaging member adapted to rest upon a floor, said vertically elongated, floor-engaging member being in telescoping relationship with said bottom end of said tubular support column for permitting said bottom end of said tubular support column to be moved upwardly and downwardly relative to said floor-engaging member, a compression spring having first and second ends, said first end of said compression spring exerting a downward force on said floor-engaging member and said second end of said compression spring exerting an upward force on said tubular support column, the improvement comprising:

said vertically elongated floor-engaging member being tubular and having an interior and having said compression spring positioned entirely within said interior, said vertically elongated floor-engaging member having vertically extending guide slots therein, a transversely extending pin secured to said tubular support column and extending through said guide slots and transversely through the interior of said vertically elongated floor-engaging member, spring stop means within said interior held by said pin, and said second end of said spring thrusting upwardly against said spring stop means.

2. In a temporary support device for use in installing construction material overhead, the improvement as claimed in claim 1, wherein:

said tubular vertically elongated floor-engaging member has a bottom end adapted to rest on a floor and said bottom end being plugged by a dirt-excluding plug for protecting said interior as a spring chamber, and said first end of said compression spring seating down on said dirt-excluding plug.

3. In a temporary support device for use in installing construction material overhead, the improvement as claimed in claim 1, wherein:

said horizontally extending member has a tubular configuration, said means connecting said horizontally extending member to said upper end of said elongated support rod are unfastenable, and the tubular configuration of said member is sufficiently large that said member can be placed around said tubular support column for providng a compact package for carrying from job-to-job or for storage.

4. In a temporary support device for use in installing construction material overhead, the improvement as claimed in claim 3, in which:

said tubular configuration is rectangular in cross section and has a top surface, and cushion pad means on said top surface adapted for supporting construction material threron in cushioned relationship.

5. In a temporary support device for use in installing construction material overhead, the improvement as claimed in claim 1, in which:

said tubular support column has a bore, said lower end of said elongated support rod includes piston means in slidable relationship within said bore of said tubular support column, substantially air-tight barrier means fixed in position in said bore below said piston means, and said tubular support column having an air-escape port therein at an elevation "H" above said barrier means for providing pneumatic damping of the descent of said elongated support rod subsequent to the release of said clutch.

6. In a temporary support device for use in installing construction material overhead, the improvement as claimed in claim 5, in which:

said elevation "H" is in the range from about 2 inches to about 6 inches.

7. In a temporary support device for use in installing construction material overhead, the improvement as claimed in claim 5, in which a stop spring is positioned within said bore of said tubular support column above said barrier means for smoothly stopping the descent of said piston means after its descent has been damped.

* * * * *